US010966505B2

(12) United States Patent
Drugeon et al.

(10) Patent No.: US 10,966,505 B2
(45) Date of Patent: Apr. 6, 2021

(54) WIPING ELEMENT WITH CONCENTRIC SKIRTS

(71) Applicant: L'OREAL, Paris (FR)

(72) Inventors: Lionel Drugeon, Clichy (FR); Jean-Marc Lebrand, Clichy (FR); William Delbove, Clichy (FR); Antoine Lebrun, Clichy (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 16/335,083

(22) PCT Filed: Sep. 22, 2017

(86) PCT No.: PCT/EP2017/074111
§ 371 (c)(1),
(2) Date: Mar. 20, 2019

(87) PCT Pub. No.: WO2018/055123
PCT Pub. Date: Mar. 29, 2018

(65) Prior Publication Data

US 2019/0216206 A1 Jul. 18, 2019

(30) Foreign Application Priority Data

Sep. 23, 2016 (FR) ..... 1658967

(51) Int. Cl.
*A45D 34/04* (2006.01)
*A45D 40/26* (2006.01)

(52) U.S. Cl.
CPC ..... *A45D 40/267* (2013.01); *A45D 34/045* (2013.01); *A45D 34/046* (2013.01); *A45D 40/265* (2013.01)

(58) Field of Classification Search
CPC .... A45D 34/045; A45D 34/046; A45D 34/04; A45D 34/042; A45D 34/047;
(Continued)

(56) References Cited

U.S. PATENT DOCUMENTS 3,870,186 A * 3/1975 Reinhard ..... A45D 34/046 220/212
4,627,454 A 12/1986 Dahm
(Continued)

FOREIGN PATENT DOCUMENTS

EP 1 518 535 A1 3/2005
EP 1 561 394 A2 8/2005
(Continued)

OTHER PUBLICATIONS

International Search Report dated Nov. 23, 2017 in PCT/EP2017/074111 filed on Sep. 22, 2017.
(Continued)

*Primary Examiner* — David J Walczak
(74) *Attorney, Agent, or Firm* — Oblon, McClelland, Maier & Neustadt, L.L.P.

(57) ABSTRACT

A wiping element of axis X includes an internal wiping skirt extended in its lower part by a wiping lip defining a wiping orifice, the internal wiping skirt being extended in its upper part by a shoulder connected to an external catching skirt by a holding portion, at least one preferably annular first groove, open towards the wiping lip, being defined between the internal wiping skirt and the external catching skirt.

14 Claims, 5 Drawing Sheets

(58) Field of Classification Search
CPC .... A45D 34/06; A45D 40/265; A45D 40/267; A45D 40/26; A45D 40/262; A45D 40/268
USPC ..... 401/121, 122, 126–130
See application file for complete search history.

(56) References Cited

U.S. PATENT DOCUMENTS

| | | | | |
|---|---|---|---|---|
| 4,733,788 | A * | 3/1988 | D'Amico | A45D 40/265 215/295 |
| 6,718,990 | B1 | 4/2004 | Chastain et al. | |
| 7,125,187 | B2 * | 10/2006 | Osti | B65D 23/00 401/128 |
| 9,957,088 | B2 * | 5/2018 | Jacob | A45D 34/046 |
| 2005/0106197 | A1 | 5/2005 | Blin et al. | |
| 2005/0175394 | A1 | 8/2005 | Gueret | |
| 2005/0220528 | A1 | 10/2005 | Petit | |
| 2011/0247230 | A1 | 10/2011 | Goldstein et al. | |
| 2012/0132222 | A1 | 5/2012 | Gueret | |
| 2012/0219345 | A1 * | 8/2012 | Kim | A45D 40/26 401/126 |

FOREIGN PATENT DOCUMENTS

| | | |
|---|---|---|
| JP | 58-008920 | 1/1983 |
| JP | 62-067011 | 3/1987 |
| JP | 2015-512740 | 4/2015 |
| WO | WO 01/08530 A1 | 2/2001 |
| WO | WO 2011/004341 A2 | 1/2011 |
| WO | WO 2012/134554 A2 | 10/2012 |

OTHER PUBLICATIONS

Japanese Office Action issued in Japanese Patent Application No. 2019-515577 dated May 18, 2020, (w/ English Translation).
Written Amendment issued in Japanese Patent Application No. 2019-515577 dated Aug. 17, 2020 (w/ English Translation).
Written Opinion issued in Japanese Patent Application No. 2019-515577 dated Aug. 17, 2020 (w/ English Translation).

* cited by examiner

Détail A

WIPING ELEMENT WITH CONCENTRIC SKIRTS

The present invention relates to devices for packaging and applying a cosmetic product and more particularly those including a receptacle containing the product to be applied and an applicator including an applicator member that is introduced into the receptacle in order to be loaded with product and passes through a wiping element as it is withdrawn from the receptacle.

The wiping element generally has a dual function, namely that of wiping off the excess product present on the stem and that of controlling the load of product on the applicator member.

TECHNOLOGICAL BACKGROUND

Various wiping elements have been proposed in publications FR 2 855 380, FR 2 865 911, FR 2 792 618, EP 1 275 322 and U.S. Pat. No. 8,221,015, with particular shapes given to the wiping lip so as to wipe the applicator member as thoroughly as possible.

One important aspect of cosmetic devices with a wiping element that contain volatile products, such as mascaras, concerns their sealing.

More generally, a cosmetic product is a product as defined in Regulation (EC) No. 1223/2009 of the European Parliament and of the Council of 30 Nov. 2009 on cosmetic products.

It has already been proposed to improve the sealing of such devices. For example, patent EP 0761123 describes a device including a reservoir provided with a wiping element and an applicator provided with a flat handle. The handle may include a sealing system such as a gasket or, alternatively, a washer that bears on a collar to reduce the passage of volatile products between the reservoir and the applicator.

Another drawback encountered when using devices that include a wiping element is that the applicator behaves like a piston when it moves into the reservoir, thereby making it difficult for the user to remove it.

WO 1997007705 has already proposed a wiping element that is adapted to the form of the applicator bristles so as to scrape the bristles in parallel to their longitudinal axis upon removal, thereby improving removal of the applicator.

There is a need to further improve wiping elements in order, notably:

- to thoroughly wipe off the stem whilst enabling the application member to be loaded with the required quantity of product,
- to provide the device with better sealing,
- to facilitate removal of the applicator.

Definition of the Invention

The invention aims to be a response to this objective and achieves that end by virtue of a wiping element of axis X comprising an internal wiping skirt extended in its lower part by a wiping lip defining a wiping orifice, the internal wiping skirt being extended in its upper part by a shoulder connected to an external catching skirt by a holding portion, at least one preferably annular first groove, open towards the wiping lip, being defined between the internal wiping skirt and the external catching skirt.

Because the junction zone specific to the invention comprises a groove, the wiping element is able to deform in order to guarantee good sealing owing to the fact that the internal wiping skirt is caused to adapt closely to the form of an applicator and to press against it. Sealing is achieved even in the case of there being manufacturing tolerances or a slight angular offset of the applicator at the neck of the receptacle when positioned. This is achieved by means of the separate skirts. High-quality sealed positioning of the applicator on the remainder of the device can be obtained.

The wiping skirt, which may have a sealing fluting, is separate from the skirt for catching on the receptacle and a skirt for holding a magnet. Sealing is perpendicular relative to the axis of closure of the cap. This architecture makes it possible to achieve a high level of sealing whilst minimising cap closure effort. The little effort needed to obtain sealing results in the use of a magnetic or mechanical retention means, affording the user comfortable use.

A further major advantage of the invention lies in that the wiping element can carry a magnet or another filler material in the groove defined in the junction zone. The number of components to be assembled in order to produce a magnet-based closure system device is reduced and the magnets can be superposed with a smaller gap.

The wiping element according to the invention may be used with a mascara or a gloss (Dip-In system), with a magnetic closure cap or by snap-fitting.

The invention also relates to a device of axis X for packaging and applying a product, particularly a care or make-up product, including:

- a receptacle for containing the product,
- an applicator affixed to a cap and comprising an application element,
- the receptacle being provided with a wiping element as defined previously, the
- wiping orifice being traversed by the application element upon its exit from the receptacle.

The device according to the invention can allow assisted opening and/or closing of the cover, based on a certain degree of movement thereof by virtue of the repelling magnets phenomenon if magnets are arranged in a groove of the wiping element, without excessively complicating the manufacture of the casing.

The internal skirt of the wiping element serves, in isolation, for guiding the cap over the throat of the receptacle at the time of closure.

The invention also relates to a cosmetic method comprising the operations consisting in:

(i) providing a device as described previously, (ii) gripping the receptacle with one hand and the applicator with the other hand, (iii) opening the device by pulling or turning on the cap, possibly to overcome the force of attraction between the first and second magnets, (iv) closing the device by bringing the cap and the receptacle together, possibly assisted by the force of attraction between the first and second magnets.

Main Definitions

The "axis X" means the longitudinal axis X.

A "cross section of a component of axis X" is a section perpendicular to the axis X of the component.

The expression "longitudinal axis" denotes the line connecting all the barycentres of the cross sections of the tab.

PREFERRED EMBODIMENTS

Preferably, the wiping element according to the invention has one or more of the following features, taken alone or in combination:

The external catching skirt extends axially over at least a quarter of the height of the internal wiping skirt, preferably over at least half the height of the internal wiping skirt and more preferably still over at least the entire height of the internal wiping skirt. This structure guarantees that the first groove, open towards the wiping lip, has sufficient depth.

The external catching skirt includes an external sealing fluting.

The holding portion includes at least one intermediate holding skirt of axis X or a collar. The structure of the holding portion is simple.

The intermediate holding skirt provides, with the external catching skirt, at least one preferably annular second groove, open towards the wiping lip. The second groove may serve as a space for housing a supplementary component.

The internal wiping skirt includes an internal surface provided with an internal sealing fluting. A sealing zone is formed.

The annular second groove houses at least a first magnet or a ballast that is fixed relative to the annular second groove.

The wiping element is formed as a single piece of one or of two materials.

Preferably, the device according to the invention has one or more of the following features, taken alone or in combination:

The wiping element or the cap includes at least a first magnet as defined previously.

The wiping element or the cap includes a ballast or at least a second magnet, the first and second magnets being, as appropriate, arranged so as to attract one another upon passage from the open position to the closed position. The device is able, without effort on the part of the user, to ensure alignment between an exterior decorative element of the cap and an exterior decorative element of the receptacle.

The first and the second magnets include one or pairs of polar zones or studs. The magnets may be superposed with a smaller gap.

The cap includes an enlarged base part and a thinned gripping part. Manual gripping of the cap is facilitated.

The product is a product to be taken from the receptacle, particularly a mascara.

DESCRIPTION OF THE FIGURES

The invention may be better understood from reading the following detailed description of non-limiting implementation examples thereof, and with reference to the appended drawing, in which.

Figure 1:
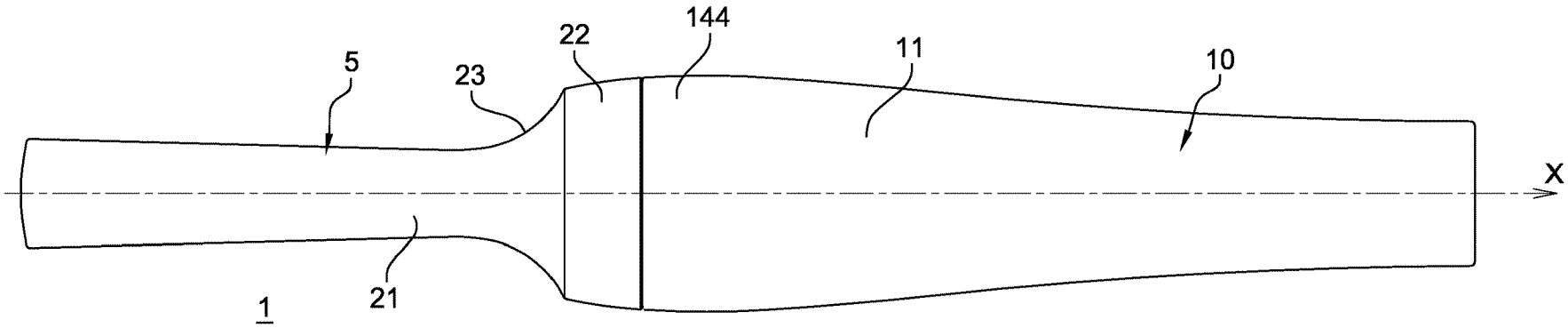
FIG. 1 shows a schematic, front view of an example of a packaging and application device according to the invention.
Figure 2:
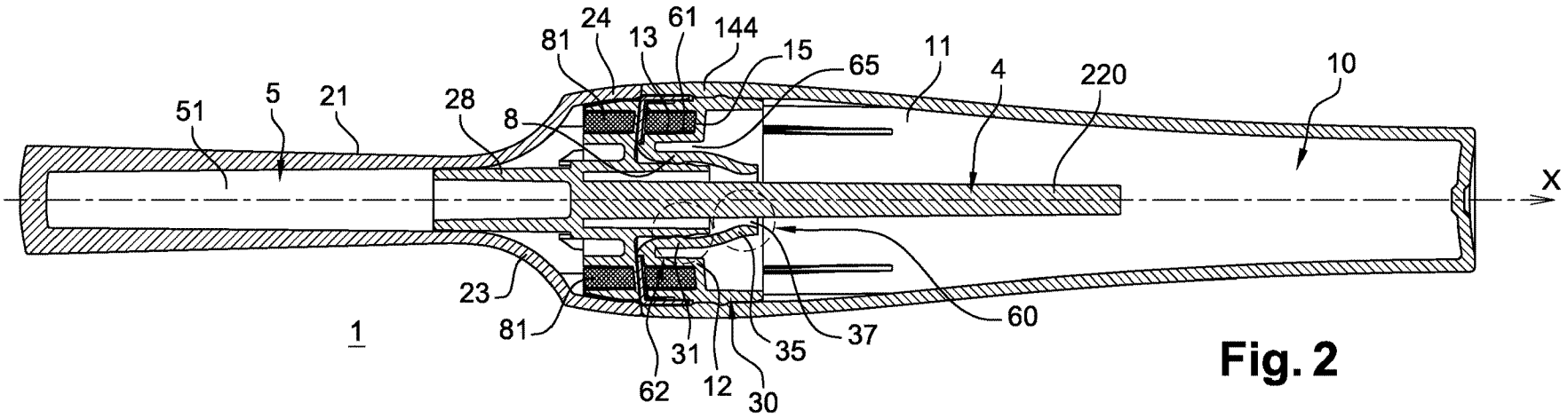
FIG. 2 is a longitudinal section through the device in FIG. 1.
Figure 4:
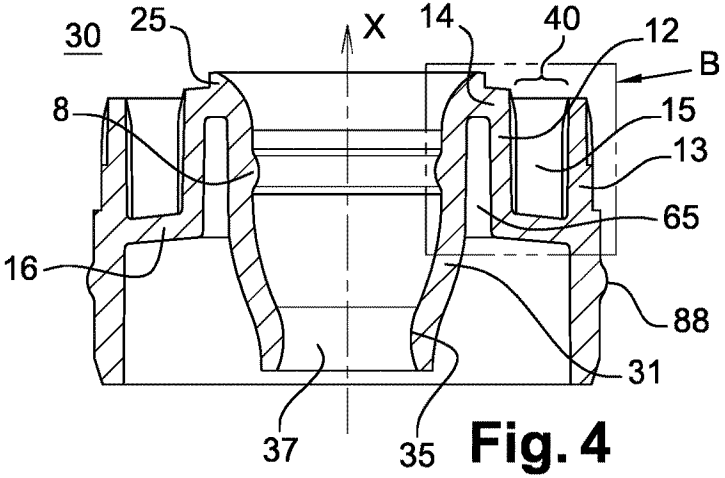
FIG. 4 is a longitudinal section through the wiping element.
Figure 6:
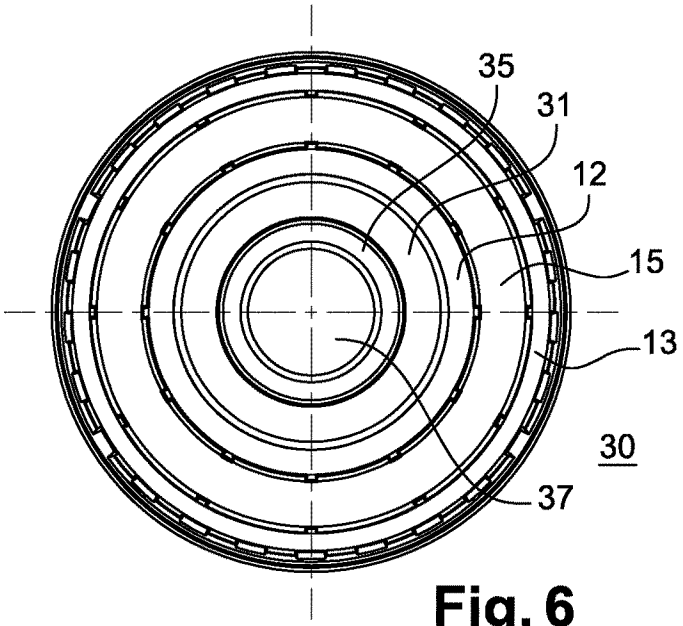
FIG. 6 is a top view of the wiping element in FIG. 3.

The packaging and application device 1 of axis X shown in FIGS. 1 and 2 has an elongate form along a longitudinal axis X that is preferably horizontal when resting on a horizontal planar surface.

The device 1 includes a receptacle 10 that may contain a mascara and a cap 5 to which an applicator 4 is affixed. The cap 5 is formed by a substantially cylindrical thinned gripping part 21 extended by an enlarged base part 22. The two parts are connected together by a tapered junction zone 23.

The applicator 4 includes a stem 220, illustrated in FIG. 2, that at its first end carries an application member (not shown) and is extended, at its second end, by a fastening end piece 28. The fastening end piece 28 is designed to be received in a corresponding housing 51 of the cap 5, for example provided in the thinned gripping part 21.

The application member is, for example, constituted by a fine brush, a stiff brush, a piece of foam or a flocked end piece, amongst other possibilities.

The body 11 of the receptacle 10 includes a neck 144 in which a wiping element 30 of axis X according to the invention is mounted, shown in FIGS. 3 to 6.

The wiping element 30 includes an internal wiping skirt 31, which is extended in its lower part by a wiping lip 35 defining a wiping orifice 37. It is extended in its upper part by a shoulder 14 connected to an external catching skirt 13 by a holding portion 40. This defines an annular groove 15, open away from the wiping lip 35, and of a depth advantageously between 1 mm and 8 mm, and in the figures equal to 4.3 mm.

The wiping element 30 is preferably produced as a single piece by moulding one or more materials, preferably a flexible thermoplastics material (PE, PP) or elastomeric thermoplastics material, for example a nitrile or SEBS. Another way in which to achieve this may be bi-injection or overmoulding in order to differentiate the catching zones, for example the skirt 13 carrying the fluting 88, from the flexible zones, for example the wiping lip 31. The wiping element 30 may be mounted forcibly in the receptacle 10, bearing on the free edge of the receptacle 10.

In the figures, the wiping element 30 has a circular cross section. The diameter of the internal wiping skirt 31 is equal to 7.3 mm and the diameter of the wiping orifice 37 is equal to 4.9 mm. The overall height of the wiping element shown is equal to 12 mm.

The cross section of the wiping element 30 could also be elliptical or oval, for example.

In the example shown, the holding portion 40 includes an intermediate holding skirt 12 connected to the external catching skirt 13 by a planar transverse wall 16 defining the bottom of the annular groove 15.

The transverse wall 16 is joined practically perpendicularly and at the mid-height of the external catching skirt 13, but it could be joined differently. For example, the transverse wall 16 could be joined obliquely to the external catching skirt 13, or have a concavity.

Figure 3:
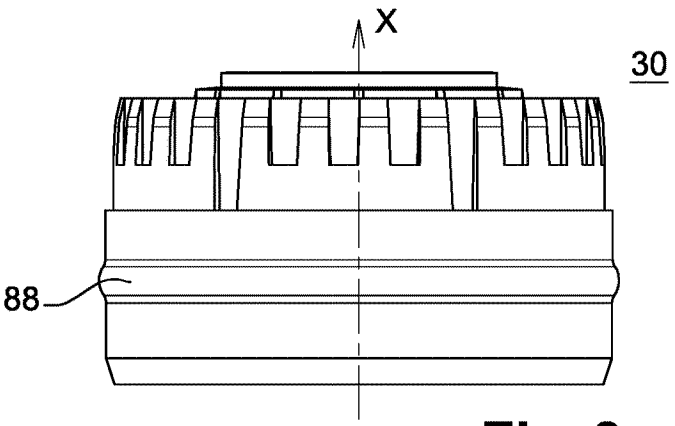
FIG. 3 shows the wiping element, in isolation and in front view.
Figure 5:
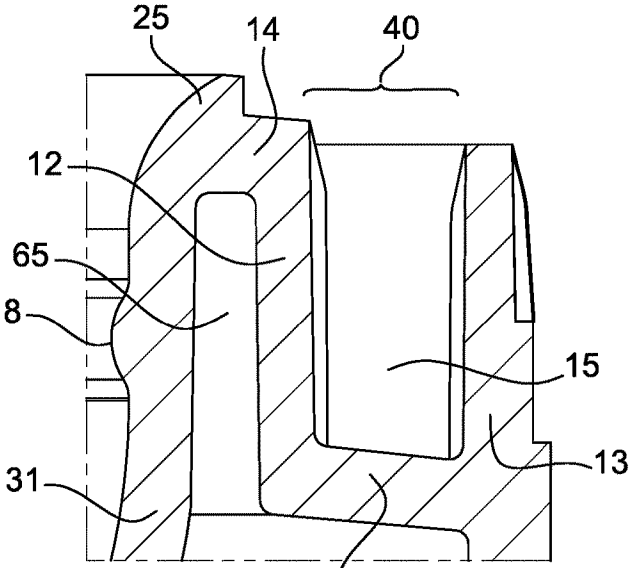
FIG. 5 shows detail B from FIG. 4.

Holding of the wiping element 30 in the receptacle 10 may be promoted by a fluting 88 provided on the exterior surface of the external catching skirt 13 of the wiping element, as may be seen in FIG. 3.

Figure 7:
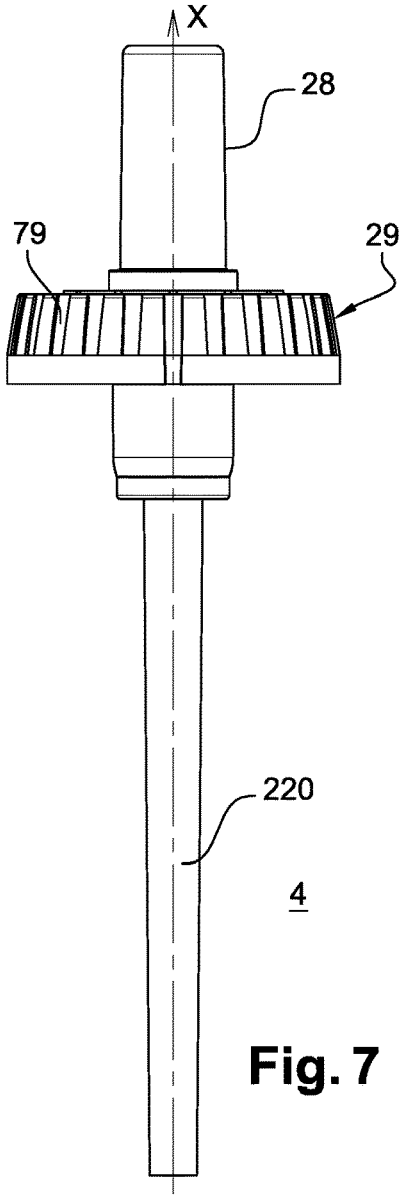
FIG. 7 shows the applicator in FIG. 1, in isolation and in front view.
Figure 8:
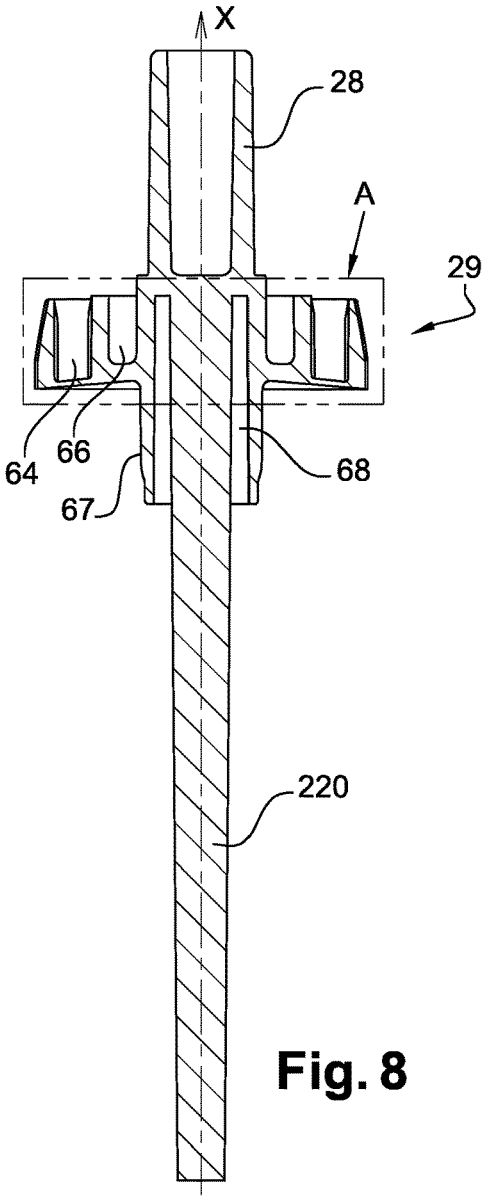
FIG. 8 is a longitudinal section through the applicator in FIG. 8.
Figure 9:
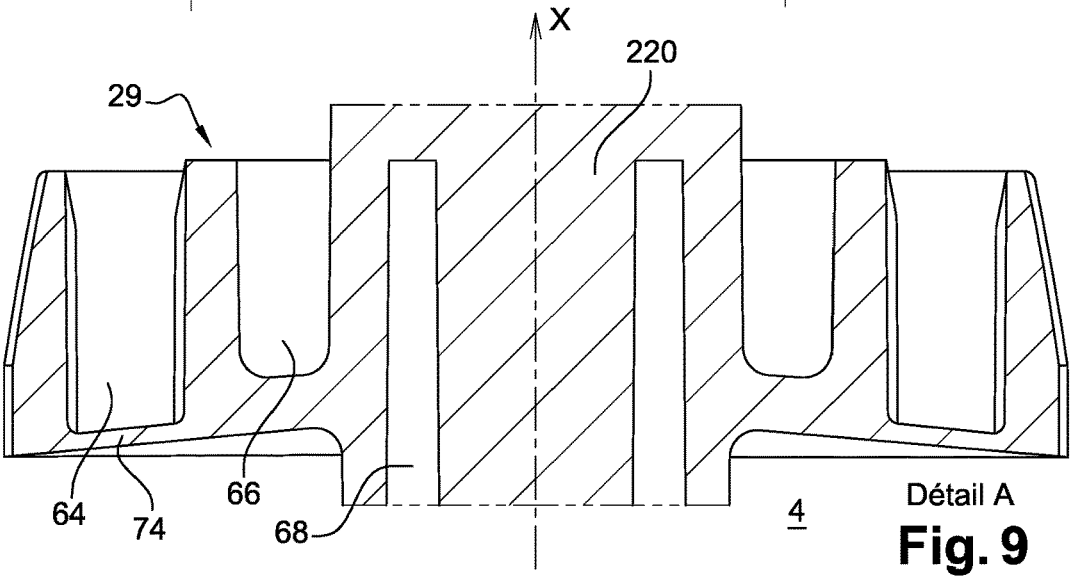
FIG. 9 shows detail A from FIG. 8.

As shown in FIGS. 7 to 9, the applicator 4 includes an annular holding collar 29 designed to bear against the wiping element 30 in the closed position of the device 1. The collar 29 defines two annular grooves 64, 66 that are remote from the stem 220 and open away from the application member. The collar 29 includes a guide part 67 capable of sliding against the internal surface of the wiping skirt 31 and defining, with the stem 220, a narrow annular groove 68 that is open towards the application member.

The applicator 4 may be formed as a single piece.

As illustrated in FIG. 7, the external face of the collar 29 may be provided with beads 79 that press on the radially internal surface of the cap 5, which can help to retain the applicator in the cap 5.

Good sealing of the device 1 is, in particular, ensured by the presence, on the wiping element 30, of one or two radial sealing zones:

- a first sealing zone 62 at the fluting 8 located on the internal face of the wiping skirt 31.
- a second sealing zone 60 at the wiping lip 31.

Axial sealing between the cap 5 and the wiping element 30 may be achieved by the annular boss 25 provided on the exterior face of the shoulder 14.

The intermediate holding skirt 12 provides, with the internal wiping skirt 31, an annular groove 65 that is open towards the wiping lip 35, in order to enhance the flexibility of the wiping element 30 and to facilitate removal of the applicator 4. This flexibility is reassuring for the user as it reduces the likelihood of product spurting out when the applicator 4 is removed, and in addition the removal action is more definite. The width of the annular groove 65 is advantageously between 0.5 mm and 5 mm. It is equal to 1.7 mm in the figures.

Magnetic means are provided to supplement the sealing system of the device 1 and to assist the movement of opening and closing the cap 5. These magnetic means may include an annular first magnet 61 inserted in the groove 15 of the wiping element 30 and an annular second magnet 81 carried by the cap 5, as may be seen in FIG. 2.

The annular first magnet 61 of axis X is, for example, mounted forcibly, snap-fitted, overmoulded or glued in the groove 15.

A second magnet 81 of axis X, of exactly the same size as the first magnet 61, is, for example, mounted in the same way in the groove 64 of the applicator 4.

The bottom wall 74 of the groove 64 is relatively thin, around 0.16 mm, to allow the magnetic field to pass between the two magnets 61 and 81.

Figure 10:
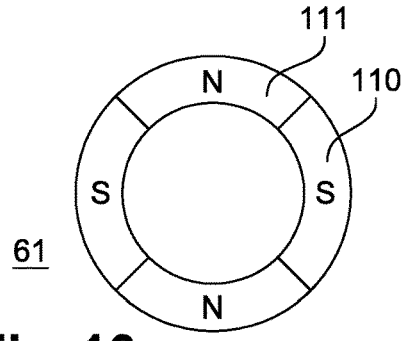
FIG. 10 is a cross section through a first example of a magnet of the wiping element of the device in FIG. 1.

With reference to FIG. 10, it will be observed that the magnet 61 may include two pairs of diametrically opposite polar zones. Thus, the polar zones N and S are regularly alternated around the axis X of the device.

Figure 11:
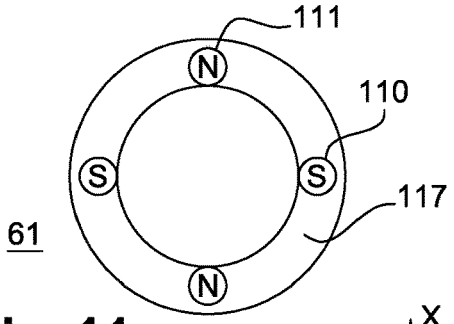
FIG. 11 is a cross section through a second example of a magnet of the wiping element of the device in FIG. 1.

In a variant, as shown in FIG. 11, the magnet 61 in FIG. 10 could be replaced by a plurality of permanently magnetised studs 110, 111 corresponding, respectively, to each polar zone of the magnet in FIG. 10. These studs 110, 111 may be overmoulded in a plastics gasket 117 prior to mounting in the wiping element 30.

The magnet 81 may be identical to the magnet 61. However, it is positioned in the cap 5 such that its polar zones on the face turned towards the receptacle 10 have an opposite magnetisation to that of the face facing the magnet 61 when the cap 5 is in its position of closing the receptacle 10.

Upon closure of the device 1, the magnetic fields created by the magnets 61 and 81 interact with one another. In an extreme case, the polar zones of each magnet facing one another have the same polarity, and then the cap 5 automatically undergoes a rotational movement about the axis X as a result of magnetic repulsion, a rotational movement which is accentuated by the attraction of the polar zones of opposite polarity of the two magnets 61 and 81, which are progressively superposed.

When all the polar zones of the two magnets are facing a polar zone of opposite polarity, the cap 5 is in a stable position relative to the receptacle 10. Simultaneously, the magnets 61, 81 maintain the cap 5 on the receptacle 10. There is thus no need to make provision for supplementary fastening means.

Of course, the number of poles or of polar zones on each magnet may be modified without departing from the scope of the invention. For example, it is possible to make provision for a plurality of polar zones of opposite polarity that are diametrically opposite on the face of one and the same magnet. Where there is a plurality of studs that are permanently magnetised, it is possible to make provision for an even or an odd number of studs.

Of course, the greater the spread of polar zones, the faster the automatic positioning system will take effect.

By way of example, the magnets may be made of neodymium-iron-boron.

Figure 12:
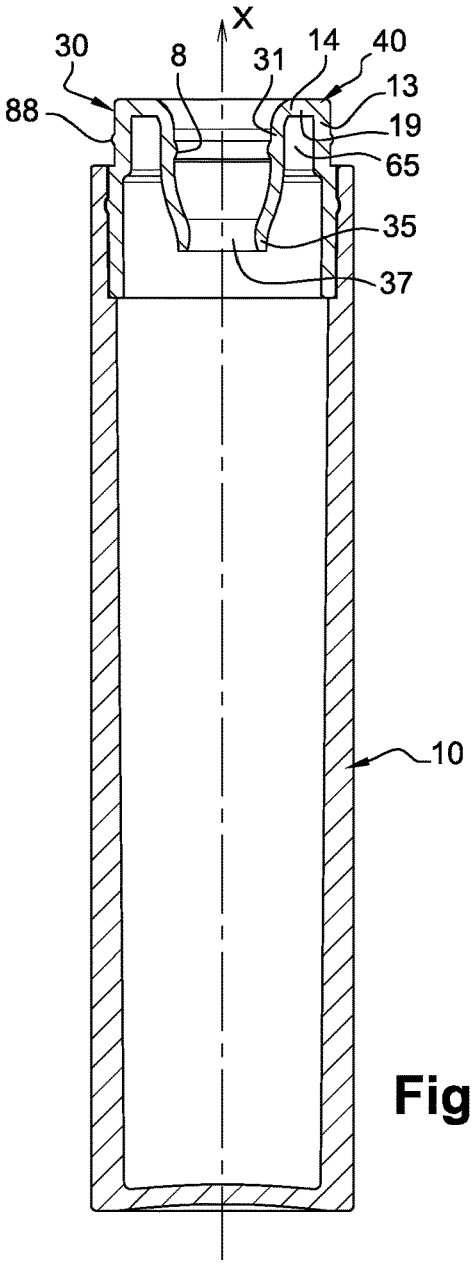
FIG. 12 is a cross section through another example of a wiping element according to the invention, mounted on a receptacle.
Figure 13:
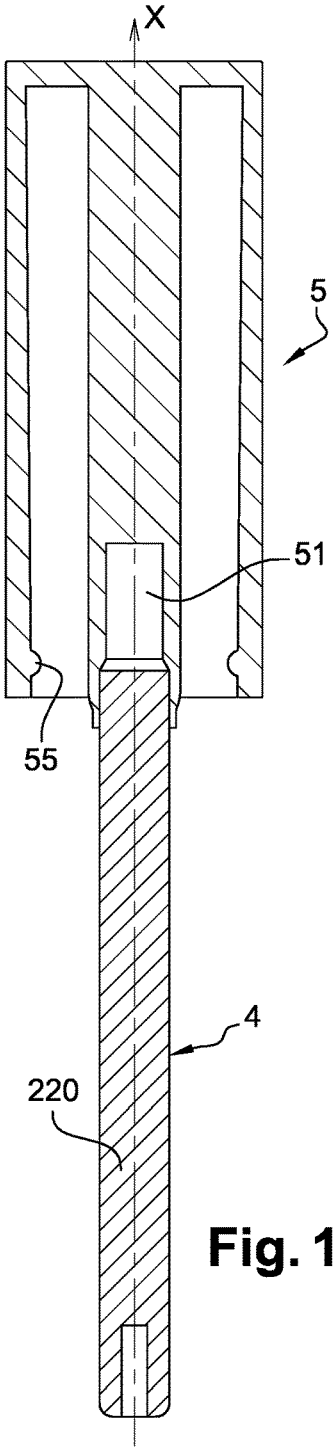
FIG. 13 is a cross section through an example of a cap that may be provided on the assembly in FIG. 12.

FIGS. 12 and 13 show an embodiment of the invention without magnets.

The wiping element 30 shown in FIG. 12 has an internal wiping skirt 31 extended in its upper part by a shoulder 14 connected to an external catching skirt 13 by a collar 19 forming a holding portion 40. An annular groove 65 open towards the wiping lip is defined between the external catching skirt 13 and the internal wiping skirt 31, the collar 19 forming the bottom of the annular groove 65.

The wiping element 30 is moulded as a single piece from polyethylene. It may be force-fitted into the receptacle 10. The external catching skirt 13 extends axially, in the example shown, beyond the internal wiping skirt 31 and the wiping lip 35.

The cap 5 shown in FIG. 13 includes a stem 220 of applicator 4 inserted into the housing 51. The cap 5 may be formed as a single piece. It may include a relief, in particular a rice grain 55, to ensure that it snap-fits on the external sealing fluting 88 of the wiping element 30.

Figure 14:
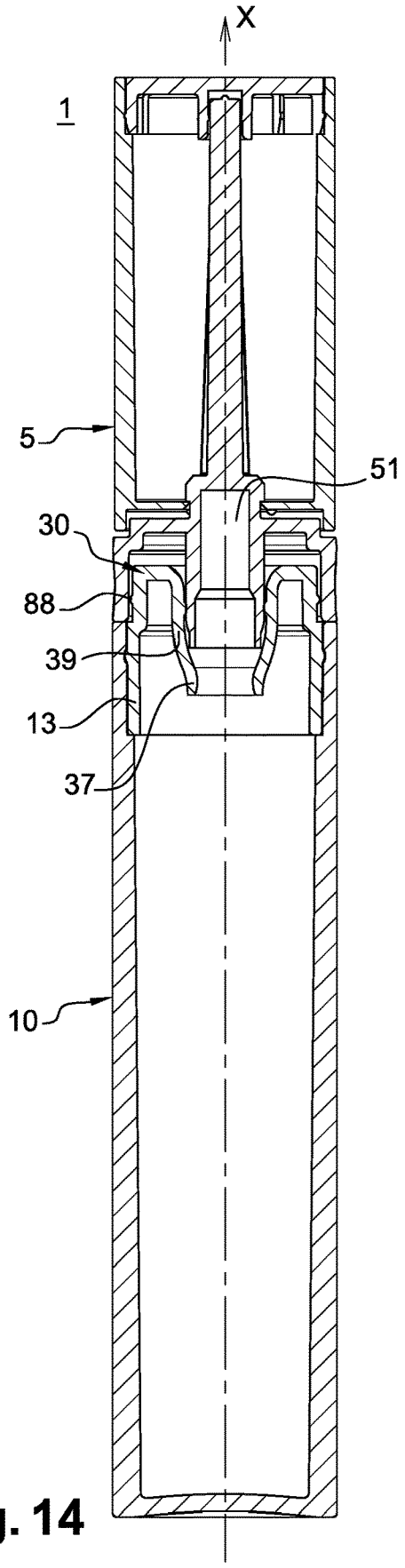
FIG. 14 is a cross section through the assembly in FIG. 12, assembled with another example of a cap.
Figure 15:
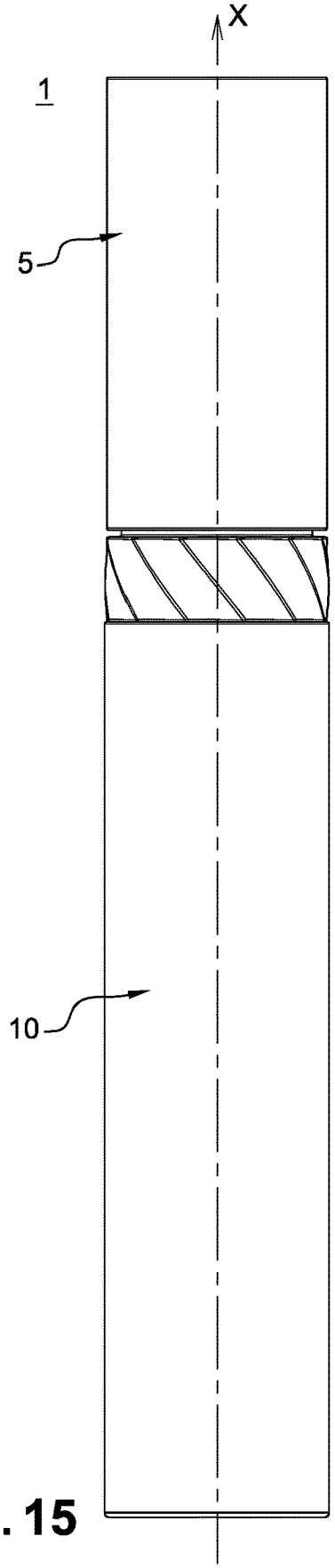
FIG. 15 is a front view of the device in FIG. 14.

The device 1 shown in FIG. 14 without an applicator includes a cap 5 without a relief to complement the fluting 88. Aside from this difference, the device is practically identical to that obtained by assembling the assembly in FIG. 12 with the cap in FIG. 13.

The invention is not limited to the exemplary embodiments just been described. It is possible, in particular, to combine together features from different embodiments and to use other forms of wiping element or stem. In particular, it is possible to provide a magnet on one side (for example, in the cap) and a ballast made from ferrous metal in the wiping element in order to achieve a system without repulsion but which is cheaper.

The invention claimed is:

1. A wiping element of axis X comprising:

an internal wiping skirt having an upper part and a lower part, the lower part being extended by a wiping lip defining a wiping orifice, wherein the upper part of the internal wiping skirt is extended by a shoulder connected to an external catching skirt by a holding portion, wherein at least one annular first groove, open towards the wiping lip, is defined between the internal wiping skirt and the external catching skirt, wherein the holding portion includes at least one intermediate holding skirt, and wherein the intermediate holding skirt provides, with the external catching skirt, at least one annular second move, open away from the wiping lip.

2. The wiping element according to claim 1, wherein the external catching skirt extends axially over at least a quarter of a height of the internal wiping skirt.

3. The wiping element according to claim 2, wherein the external catching skirt extends axially over at least the entire height of the internal wiping skirt.

4. The wiping element according to claim 1, wherein the external catching skirt includes an external sealing fluting.

5. The wiping element according to claim 1, wherein the internal wiping skirt includes an internal surface provided with an internal sealing fluting.

6. The wiping element according to claim 1, wherein the annular second groove houses at least a first magnet or a ballast that is fixed relative to the annular second groove.

7. The wiping element according to claim 1, wherein the wiping element is formed as a single piece of one or of two materials.

8. A device of axis X for packaging and applying a product, particularly a care or make-up product, including:

a receptacle for containing the product, an applicator affixed to a cap and comprising an application element, wherein the receptacle is provided with a wiping element as defined according to claim 1, the wiping orifice being traversed by the application element upon its exit from the receptacle.

9. The device according to claim 8, wherein the wiping element or the applicator includes at least a first magnet.

10. The device according to claim 9, wherein the wiping element or the applicator includes a ballast or at least a second magnet, the first and second magnets being, as appropriate, arranged so as to attract one another upon passage from an open position to a closed position.

11. A cosmetic method comprising:

(i) providing a device according to claim 10, (ii) gripping the receptacle with one hand and the applicator with the other hand, (iii) opening the device by pulling or turning on the cap, to overcome a force of attraction between the first and second magnets, (iv) closing the device by bringing the cap and the receptacle together, assisted by the force of attraction between the first and second magnets.

12. The device according to claim 10, wherein the first and second magnets include one or pairs of polar zones or studs.

13. The device according to claim 8, wherein the cap includes an enlarged base part and a thinned gripping part.

14. The device according to claim 8, wherein the product configured to be taken from the receptacle is a mascara.

* * * * *